US005558000A

United States Patent [19]

Sawamura

[11] Patent Number: 5,558,000

[45] Date of Patent: Sep. 24, 1996

[54] HIGH SPEED AND HIGH LOAD CYLINDER DEVICE

[75] Inventor: Hitoshi Sawamura, Komatsu, Japan

[73] Assignee: Kabushiki Kaisha Komatsu Seisakusho, Tokyo, Japan

[21] Appl. No.: 424,417

[22] PCT Filed: Oct. 18, 1993

[86] PCT No.: PCT/JP93/01497

§ 371 Date: Apr. 26, 1995

§ 102(e) Date: Apr. 26, 1995

[87] PCT Pub. No.: WO94/11639

PCT Pub. Date: May 26, 1994

[30] Foreign Application Priority Data

Nov. 19, 1992 [JP] Japan ..... 4-309843

[51] Int. Cl.[6] ..... F01B 1/00; F15B 11/00

[52] U.S. Cl. ..... 91/164; 91/519; 91/535

[58] Field of Search ..... 91/164, 158, 152, 91/153, 159, 519, 535, 170 R, 178, 183, 157; 92/62, 65, 61; 97/222, 224, 228

[56] References Cited

U.S. PATENT DOCUMENTS

| | | | |
|---|---|---|---|
| 2,661,726 | 12/1953 | Alfieri | 91/224 |
| 4,286,929 | 9/1981 | Heath et al. | 91/164 X |
| 4,638,718 | 1/1987 | Nakamura | 91/183 X |
| 5,031,509 | 7/1991 | Cowan | 91/222 X |
| 5,191,825 | 3/1993 | Beneteau et al. | 92/65 X |

FOREIGN PATENT DOCUMENTS 47-31075 11/1972 Japan .

63-67404 3/1988 Japan .

*Primary Examiner*—Hoang Nguyen

*Attorney, Agent, or Firm*—Frishauf, Holtz, Goodman, Langer & Chick

[57] ABSTRACT

A high speed and high load cylinder device is constructed by connecting a piston of a high speed cylinder (1) having a smaller pressure receiving area and a piston of a pressurizing cylinder (2) having a large pressurizing area. The device is provided with a hydraulic circuit for supplying a hydraulic pressure to the high speed cylinder and the pressurizing cylinder. The device has a sequence valve (5) at an intermediate position in a passage (**2*e*) providing in the piston of the pressurizing cylinder for communicating an upper chamber ($\mathbf{2_1}$) and a lower chamber ($\mathbf{2_2}$) of the pressurizing cylinder for opening and closing the passage depending upon a pilot pressure. A pilot pressure is supplied for closing the sequence valve by supplying the pilot pressure to the sequence valve. A high speed/pressurizing switching valve (12) is provided at an intermediate position in a piping (11) supplying the hydraulic pressure to the upper chamber of the pressurizing cylinder in the hydraulic circuit. The high speed/pressuring switching valve (12) is closed when high speed operation is required, by not submitting the pilot pressure to the sequence valve (5). The high speed/pressurizing switching valve (12**) is open when high pressurizing force is required, by supplying the pilot valve to the sequence valve (5). With the construction, it becomes possible to perform high speed operation by the high speed cylinder and operation coping with high load by the pressurizing fluid without providing the external piping and valve.

5 Claims, 4 Drawing Sheets

HIGH SPEED AND HIGH LOAD CYLINDER DEVICE

FIELD OF THE INVENTION

The present invention relates to a high speed and high load cylinder device applicable for driving a power source for a press machine, a machine tool and so forth.

BACKGROUND OF THE INVENTION

In the prior art, there is a known high speed and high load cylinder device applicable for a press machine, such as a turret punch press and so forth, a machine tool and so forth, which is illustrated in FIG. 1, for example.

The above-mentioned cylinder device is constructed by connecting a piston of a high speed cylinder a, to be operated at high speed, and a piston of a pressurizing cylinder b bearing a high load, via a piston rod, and by communicating upper and lower chambers of the pressurizing cylinder b via an externally provided piping d and a valve c provided in the piping. Upon high speed operation, the upper and lower chambers of the pressurizing cylinder b communicate by opening the valve c so that a pressure difference is not caused even when a hydraulic pressure is supplied from a hydraulic circuit f to enable high speed operation of the high speed cylinder. Upon generating a large pressure force, the valve c is closed so that a pressure difference may be generated between the upper and lower chambers of the pressurizing cylinder b so as to cope with high load by the pressurizing cylinder b. It should be noted that, in FIG. 1, g denotes a hydraulic pump, h denotes a switching valve and i denotes a tank.

However, since the above-mentioned conventional cylinder device is provided externally of the valve c and the piping d, the stroke of the pressurizing cylinder b becomes long so as to expand the length of piping d in association therewith. This causes a problem of creating a high fluid path resistance during high speed operation when a large amount of a working fluid at one time is to be fed.

Also, for permitting flow of a large amount of the working fluid, a large diameter piping and large size valve c become necessary to make the device per se costly. Furthermore, since the construction becomes complicated, it may cause leakage.

The present invention is worked out for improving such defects in the prior art. It is an object of the present invention to provide a high speed and high load cylinder device which enables operation corresponding to high speed operation and high load operation without requiring an external piping.

DISCLOSURE OF THE INVENTION

In order to accomplish the above-mentioned and other objects, a high speed and high load cylinder device constructed by connecting a piston of a high speed cylinder having a smaller pressure receiving area and a piston of a pressurizing cylinder having a large pressurizing area, and providing a hydraulic circuit for supplying a hydraulic pressure to the high speed cylinder and the pressurizing cylinder, comprises:

a sequence valve being provided at an intermediate position in a passage providing in the piston of the pressurizing cylinder for communicating an upper chamber and a lower chamber of the pressurizing cylinder for opening and closing the passage depending upon a pilot pressure, and a pilot pressure being provided for closing the sequence valve by supplying the pilot pressure to the sequence valve;

a high speed/pressurizing switching valve being provided at an intermediate position in a piping supplying the hydraulic pressure to the upper chamber of the pressurizing cylinder in the hydraulic circuit;

the high speed/pressurizing switching valve being closed when high speed operation is required, by not submitting the pilot pressure to the sequence valve; and the high speed/pressurizing switching valve being open when high pressurizing force is required by supplying the pilot pressure to the sequence valve.

With the construction, it becomes possible to perform high speed operation by the high speed cylinder and operation coping with high load by the pressurizing fluid without providing the external piping and valve.

Preferably, the pistons of both cylinders are connected via a piston rod and a pilot pressure supply passage is defined in the piston rod.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

BEST MODE FOR IMPLEMENTING THE INVENTION

One embodiment of a high speed and high load cylinder device according to the present invention will be explained hereinafter with reference to FIGS. 2 to 4.

Figure 1:
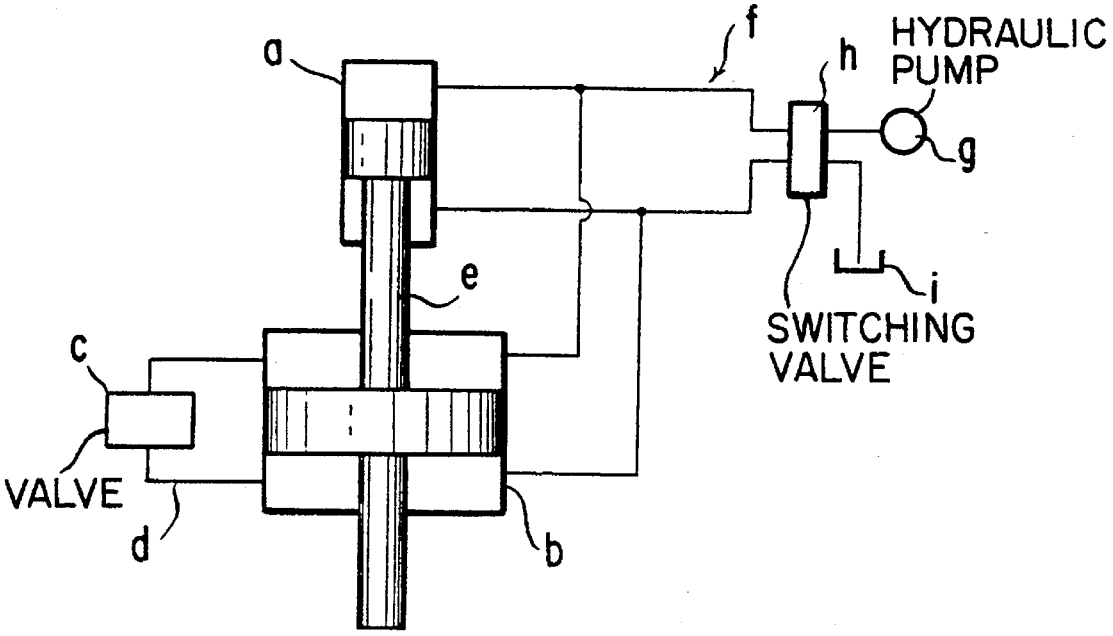
FIG. 1 PRIOR ART
FIG. 1 is a general illustration of the conventional high speed and high load cylinder device.
Figure 2:
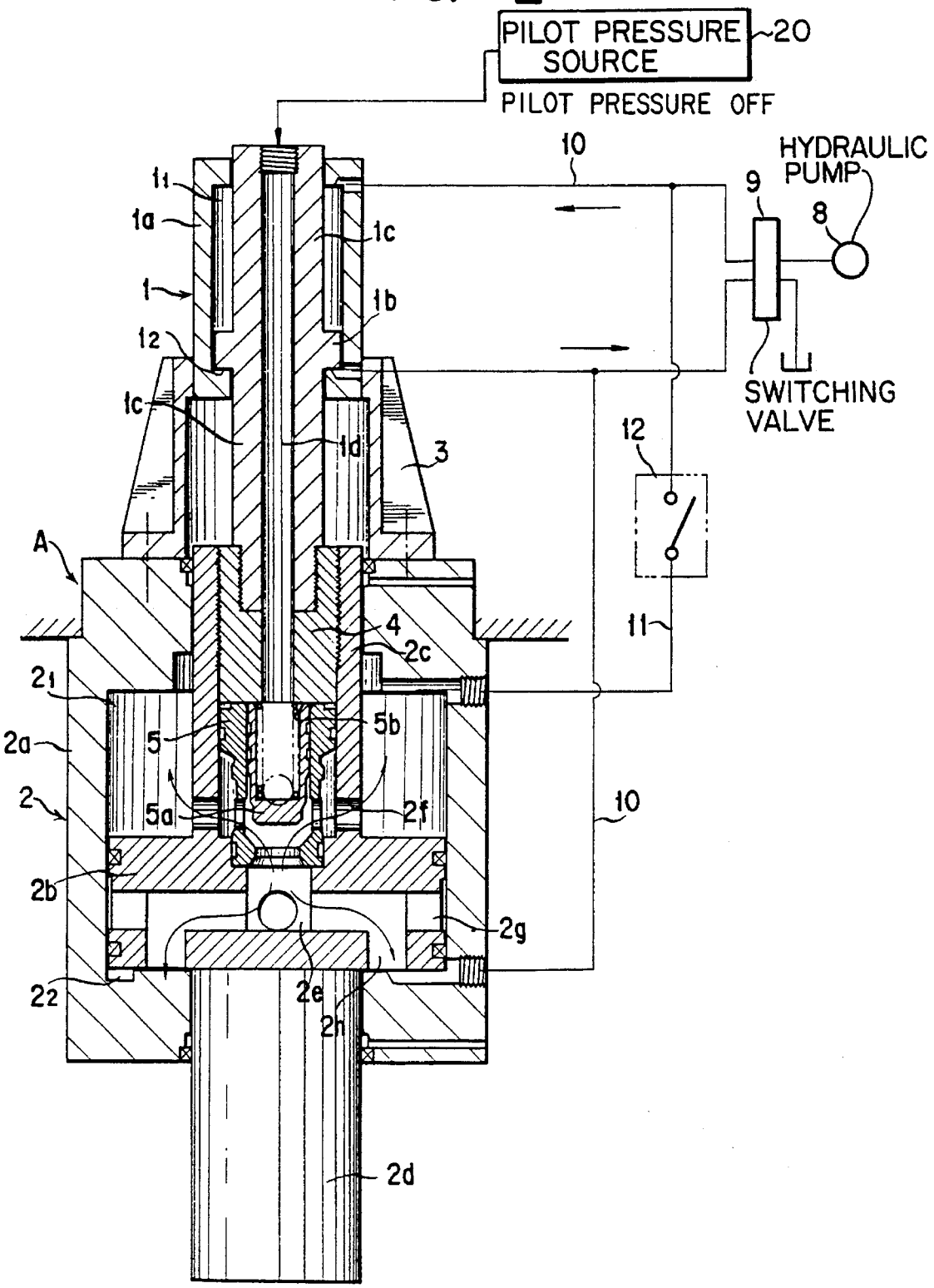
FIG. 2 is a section of one embodiment of a high speed and high load cylinder device according to the present invention, which is illustrated in a position of high speed operation.

In FIG. 2, A denotes a main body of the device, which is basically constructed by connecting a piston rod of a high speed cylinder 1 having a small pressure receiving area and a piston rod of a pressurizing cylinder 2 having a large pressure receiving area.

The high speed cylinder 1 has a cylinder portion 1*a* mounted on a cylinder portion 2*a* of the pressurizing cylinder 2 via a bracket 3 in co-axial fashion. Within the cylinder portion la of the high speed cylinder 1, a piston 1*b* is disposed. By the piston 1*b*, the interior space of the cylinder portion 1*a* is divided into an upper chamber $\mathbf{1}_1$ and a lower chamber $\mathbf{1}_2$. On the upper and lower surfaces of the piston 1*b*, a piston rod 1*c* is extended upwardly and downwardly.

The piston rod 1*c* extending upwardly is extended upwardly from the cylinder portion 1*a*. On the other hand, the tip end of the piston rod 1*c* extending downwardly is connected to the upper end of a piston rod 2*c* of the pressurizing cylinder 2. On the other hand, a passage 1*d* is formed within the piston rod 1 so as to supply a pilot pressure from a pilot pressure source 20 within the passage 1*d*.

Similarly, within the cylinder portion 2*a* of the pressurizing cylinder 2, a piston 2*b* is disposed. The piston 2*b* divides the interior space of the cylinder portion 2*a* into an upper chamber $2_1$ and a lower chamber $2_2$. On the upper surface of the cylinder portion 2*b*, a hollow piston rod 2*c* is extended. Also, on the lower surface of the piston 2*b*, the piston rod 2*d* is extended.

Within the piston rod 2*c* extending upwardly, a sequence valve 5 is provided.

The sequence valve 5 is biased downwardly by means of a compression spring 5*b*, and has a valve body 5*a* operable by a pilot pressure supplied through the passage 1*d* in the piston rod 1*c* of the high speed piston 1. By the closing operation of the valve body 5*a*, a passage 2*e* in the piston 2*b* communicating the upper chamber $2_1$ and the lower chamber $2_2$ of the pressurizing cylinder 2 is shut off.

One end of the passage 2*e* is communicated with the upper chamber $2_1$ via a plurality of through holes 2*f* formed in the outer circumference of the hollow piston rod 2*c*, and the other end is communicated with a plurality of communication portions 2*g* opening to the outer circumference of the piston 2*b* and is further communicated with the lower chamber $2_2$ via a plurality of through holes 2*h* opening to the lower surface.

In the drawings, 8 denotes a hydraulic pump. The fluid discharged from the hydraulic pump 8 is supplied to the upper chambers $1_1$ and $2_1$ and the lower chambers $1_2$ and $2_2$ of the high speed cylinder 1 and the pressurized cylinder 2 via a piping 10 from a switching valve 9. In a piping 11 for supplying the discharged fluid to the upper chamber $2_1$ of the pressurizing cylinder 2 is provided with a high speed/pressurizing switching valve 12 located at the intermediate position thereof.

Next, operation of the apparatus will be discussed.

When the main body A is operated at high speed, the pilot pressure is shut off and high speed/pressurizing switching valve 12 is also shut off.

At this condition, the switching valve 9 is switched into one position to supply the hydraulic pressure to the upper chamber $1_1$ of the high speed cylinder 1. Then, the piston 1*b* of the high speed cylinder 1 having the smaller pressure receiving area is shifted at high speed as illustrated by "l" of a working fluid velocity curve. At the same time, the piston 2*b* of the pressurizing cylinder 2 is also shifted at high speed. At this time, the fluid in the lower chamber $2_2$ of the pressurized cylinder 2 flows into the upper chamber $2_1$ while upwardly depressing the valve body 5*a* of the sequence valve 5, from the passage 2*e*, as shown in FIG. 2.

Figure 3:
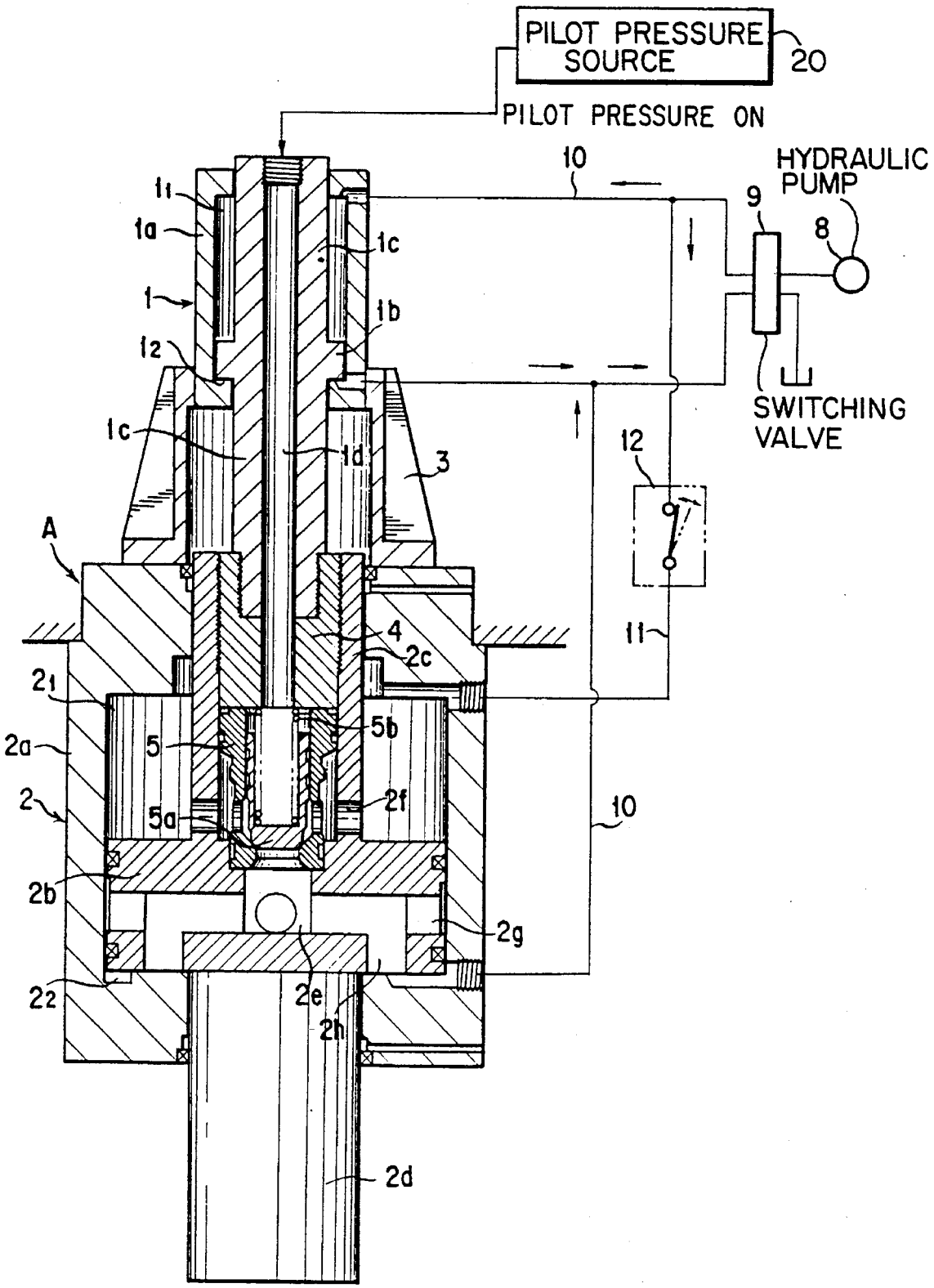
FIG. 3 is a section of the embodiment in the position of high load operation.

Subsequently, at a moment where a die driven by the piston rod 2*d* of the pressurizing cylinder 2 contacts with a work 14, for example, the pilot pressure and the high speed/pressurizing switching valve 12 are turned ON to close the valve body 5*a* of the sequence valve 5 by the pilot pressure as shown in FIG. 3. In conjunction therewith, the hydraulic pressure of the hydraulic pump 8 is also supplied to the upper chamber $2_1$ of the pressurizing cylinder 2.

By this, the discharged pressure of the hydraulic pump 8 acts on the piston 2*b* having the large pressure receiving area to generate a large pressure force. Also, the piston 2*b* is decelerated as shown by "m" in FIG. 4.

Then, the work 14 is punched by the die, in conjunction therewith the pilot pressure and the high speed/pressurizing switching 12 are turned off. Then, the switching valve 9 is switched into another position.

Figure 4:
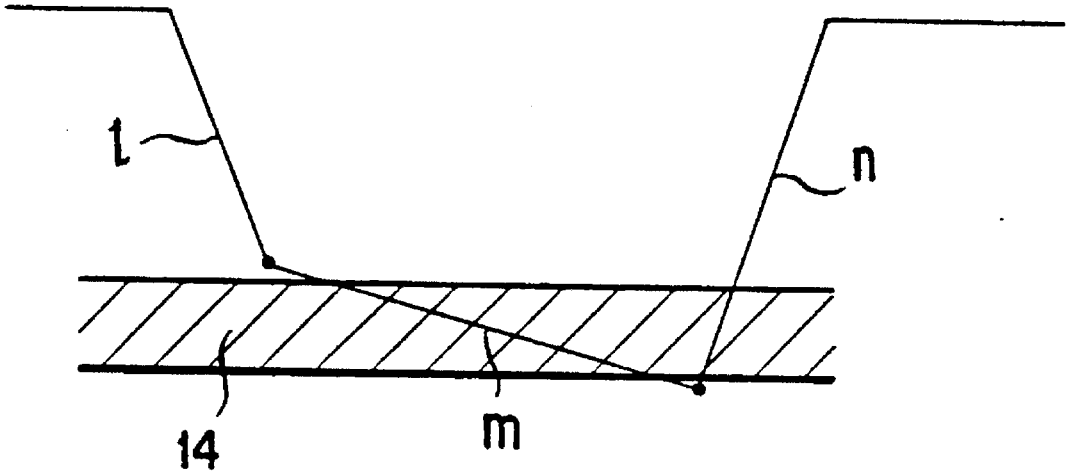
FIG. 4 is a graph showing variation of operation speed of the embodiment.

When the hydraulic pressure is supplied to the lower chamber $1_2$ of the high speed cylinder, the piston 2*b* of the pressurizing cylinder 2 is shifted upwardly as shown by "n" in FIG. 4. At this time, the fluid in the upper chamber $2_1$ of the pressurizing cylinder 2 upwardly depresses the valve body 5*a* of the sequence valve 5 to flow into the lower chamber $2_2$.

By repeating the foregoing operation, a body to be driven can be driven at high speed initially and with a large pressure force upon contacting work 14.

It should be noted that, while the foregoing is the operation to punch the work 14, such as that of the turret punch press, an arbitrary speed curve can be obtained by varying the operation timing of the high speed/pressurizing switching valve 12.

As discussed in detail, the present invention transits from high speed operation to pressurizing operation by turning ON and OFF the sequence valve provided in the piston of the pressurizing cylinder by the pilot pressure, so that the external piping and valve and so forth as required in the prior art, become unnecessary.

Accordingly, even when the stroke of the pressurizing cylinder becomes large, it will not restrict high speed operation by the increased flow passage resistance. Also, since the external piping and valve are not required, the device can be constructed economically.

On the other hand, since the construction is simple, production can be done easily at low cost. Furthermore, maintenance of such device becomes easy.

Although the invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

INDUSTRIAL APPLICABILITY

As set forth above, the high speed and high load cylinder device according to the present invention is quite useful as the driving power source for the press and machine tool.

I claim:

1. A high speed and high load cylinder device comprising:

a high speed cylinder including a first piston disposed therein and having an effective area, and first and second fluid chambers defined in an interior space of said high speed cylinder by said first piston;

a high pressure cylinder including a second piston disposed therein and cooperating with said first piston of said high speed cylinder, said second piston having an effective area which is larger than said effective area of said first piston, and third and fourth fluid chambers defined in an interior space of said high pressure cylinder by said second piston, said second piston defining a communication passage for selectively communicating said third and fourth fluid chambers with each other;

a hydraulic circuit connected to said high speed cylinder and to said high pressure cylinder for supplying hydraulic pressure thereto, said hydraulic circuit including a fluid path communicating with one of said third and fourth fluid chambers for supplying the hydraulic pressure thereto;

first valve means disposed in said communication passage for selectively establishing and blocking communication between said third and fourth fluid chambers;

first valve control means for controlling a position of said first valve means for selectively establishing and blocking communication between said third and fourth fluid chambers, said first valve control means operating said first valve means at an open position in a high speed mode operation and at a closed position in a high load mode operation; and second valve means disposed in said fluid path for selectively establishing and blocking communication between said hydraulic circuit and said one of said third and fourth fluid chambers, said second valve means establishing communication between said hydraulic circuit and said one of said third and fourth fluid chambers during said high load mode operation.

2. A high speed and high load cylinder device comprising:

a high speed cylinder including a first piston having a first effective area, and first and second fluid chambers defined in the interior space of said high speed cylinder by said first piston;

a high pressure cylinder including a second piston cooperating with said first piston of said high speed cylinder and having a second effective area which is greater than said first effective area of said first piston, and third and fourth fluid chambers defined in the interior space of said high pressure cylinder by said second piston, said second piston defining a communication passage for communicating said third and fourth fluid chambers with each other;

a hydraulic circuit connected to said high speed cylinder and to said high pressure cylinder for supplying hydraulic pressure thereto, said hydraulic circuit including a fluid path communicated with one of said third and fourth fluid chambers for supplying the hydraulic pressure thereto;

first valve means disposed in said communication passage for selectively establishing and blocking communication between said third and fourth fluid chambers;

first valve control means, including a pilot pressure source, for controlling a position of said first valve means for selectively establishing and blocking communication between said third and fourth fluid chambers, said first valve control means operating said first valve means at an open position in a high speed mode operation and at a closed position in a high load mode operation; and said first and second pistons being connected together through an integrated piston rod which defines an axially extending through-opening communicated with said first valve means at one end, the other end of said axially extending through-opening being connected to said pilot pressure source so as to have said first valve control means supply a pilot pressure for placing said first valve means at said closed position during said high load mode operation.

3. A high speed and high load cylinder device comprising:

a high speed cylinder having a first piston disposed therein, said first piston having a pressure receiving area;

a pressurizing cylinder having a second piston disposed therein, said second piston having a pressurizing area which is larger than said pressure receiving area of said first piston;

a hydraulic circuit for supplying a hydraulic pressure to said high speed cylinder and to said pressurizing cylinder;

a fluid passage in said second piston for providing communication between an upper chamber and a lower chamber of said pressurizing cylinder by said second piston;

a sequence valve provided at an intermediate position in said fluid passage of said second piston for opening and closing said fluid passage depending upon a pilot pressure;

a pilot pressure source for generating said pilot pressure;

a high speed/pressurizing switching valve provided at an intermediate position in a piping which supplies hydraulic pressure to the upper chamber of said pressurizing cylinder, said high speed/pressurizing switching valve being closed when a high speed operation is required, and at the same time, the pilot pressure not being supplied to the sequence valve, and said high speed/pressurizing switching valve being open when a high pressurizing force is required, for supplying the pilot pressure to the sequence valve.

4. A high speed and high load cylinder device as set forth in claim 3, further comprising:

a piston rod which connects together said pistons of both of said high speed and pressurizing cylinders; and a pilot pressure supply passage defined in said piston rod for supplying the pilot pressure to the fluid passage in the second piston.

5. A high speed and high load cylinder device as set forth in claim 1, wherein said first valve control means controls the position of said first valve means, independent of said first piston.

* * * * *

UNITED STATES PATENT AND TRADEMARK OFFICE

CERTIFICATE OF CORRECTION

PATENT NO. : 5,558,000
DATED : September 24, 1996
INVENTOR(S) : Sawamura

It is certified that error appears in the above-indentified patent and that said Letters Patent is hereby corrected as shown below:

Title page, Item [57] ABSTRACT,

Cancel the Abstract, and in place thereof, insert the following new Abstract:

--A high speed and high load cylinder device includes a piston of a high speed cylinder having a smaller pressure receiving area, connected to a piston of a pressurizing cylinder having a larger pressurizing area. A hydraulic circuit supplies a hydraulic pressure to the high speed cylinder and to the pressurizing cylinder. A sequence valve is provided at an intermediate position in a passage in the piston of the pressurizing cylinder for communicating an upper chamber with a lower chamber of the pressurizing cylinder for opening and closing the passage depending upon a pilot pressure. A pilot pressure is supplied for closing

UNITED STATES PATENT AND TRADEMARK OFFICE

CERTIFICATE OF CORRECTION

PATENT NO. : 5,558,000

DATED : September 24, 1996

INVENTOR(S) : Sawamura

It is certified that error appears in the above-indentified patent and that said Letters Patent is hereby corrected as shown below:

the sequence valve. A high speed/pressurizing switching valve is provided at an intermediate position in a piping supplying the hydraulic pressure to the upper chamber of the pressurizing cylinder in the hydraulic circuit. The high speed/pressurizing switching valve is operated when high speed operation is required so that the pilot pressure is not supplied in order to keep the sequence valve open. When a high pressurizing force is required, the pilot pressure is supplied to close the sequence valve. A high speed operation can be performed by the high speed cylinder, and an operation requiring a high pressurizing force can be provided without providing external piping and an external valve.--

Signed and Sealed this

Twenty-first Day of January, 1997

*Attest:*

Bruce Lehman

BRUCE LEHMAN

*Attesting Officer*

*Commissioner of Patents and Trademarks*